United States Patent [19]

Kommineni

[11] Patent Number: 4,750,002

[45] Date of Patent: Jun. 7, 1988

[54] ANTENNA PANEL HAVING ADJUSTABLE SUPPORTS TO IMPROVE SURFACE ACCURACY

[75] Inventor: Prasad R. Kommineni, Melbourne, Fla.

[73] Assignee: Harris Corporation, Melbourne, Fla.

[21] Appl. No.: 907,205

[22] Filed: Sep. 12, 1986

[51] Int. Cl.[4] ..... H01Q 15/20

[52] U.S. Cl. ..... 343/915

[58] Field of Search ..... 343/915, 840, 912, 914, 343/916

[56] References Cited

U.S. PATENT DOCUMENTS

| | | | |
|---|---|---|---|
| 3,239,839 | 3/1966 | Banche et al. | 343/915 |
| 3,401,390 | 9/1968 | Braccini et al. | 343/915 |
| 3,541,569 | 11/1970 | Berks et al. | 343/915 |
| 3,550,142 | 3/1970 | Dawson | 343/781 |
| 3,867,019 | 2/1975 | Eyerman | 343/915 |
| 4,021,817 | 5/1977 | Shibano et al. | 343/912 |
| 4,066,343 | 1/1978 | Scott | 343/915 |
| 4,352,113 | 9/1982 | Labryere | 343/915 |
| 4,358,183 | 11/1982 | Whiteford | 350/288 |
| 4,468,849 | 9/1984 | Anderson et al. | 29/526 R |
| 4,506,271 | 3/1985 | Gonzalez | 343/915 |
| 4,571,594 | 2/1986 | Haupt | 343/915 |

*Primary Examiner*—William L. Sikes
*Assistant Examiner*—Robert E. Wise
*Attorney, Agent, or Firm*—John L. DeAngelis, Jr.

[57] ABSTRACT

An apparatus providing a post-fabrication shapable antenna reflector panel. Several such shapable antenna reflector panels can be arranged to form a complete antenna reflector. Each panel includes a panel skin and a rigid frame member, with adjustable supports interposed therebetween. The adjustable supports, which are rods having a threaded portion with lock nuts threadably engaged thereon, are attached to the back side of the panel skin and placed within holes in the frame. With one lock nut located above and another located below the frame holes, the panel skin can be held securely in position by urging each lock nut against the frame. The panel skin can also be adjusted by appropriately releasing, moving, and then retightening the lock nuts. The adjustable supports are arranged in a matrix pattern so that the shape of the panel skin can be adjusted in a uniform manner.

3 Claims, 1 Drawing Sheet

ANTENNA PANEL HAVING ADJUSTABLE SUPPORTS TO IMPROVE SURFACE ACCURACY

FIELD OF THE INVENTION

This invention relates to an antenna panel having adjustable supports interposed between the panel and a rigid frame member, such that adjustment of the adjustable supports changes the curvature of the antenna panel.

BACKGROUND OF THE INVENTION

To provide desired amplitude and phase characteristics, antenna reflectors are often shaped, i.e., the surface shape of the antenna is changed from a conic section (parabola, paraboloid, ellipse, ellipsoid, hyperbola, or hyperboloid) to a new curvature or shape. This shaping feature is used advantageously in a commonly-owned patent entitled, "*Compact Antenna Range Employing Shaped Reflectors*", U.S. Pat. No. 4,688,325, issued on Aug. 25, 1987. The shaping of antenna reflectors is also discussed in an article entitled, "*Minimum-Noise Maximum-Gain Telescopes And Realization Method For Shaped Asymmetric Surfaces*", by Sebastian VonHoerner, appearing in the I.E.E.E. Transactions on Antennas and Propagation, Volume AP-26, No. 3, May 1978, pages 464 through 471.

In a typical antenna panel fabrication operation, a flexible metal panel or skin is securely clamped to a solid bonding fixture having a predetermined shape. A honeycomb backup structure is glued to the metal skin and then a second metal panel or skin is glued to the exposed side of the honeycomb structure. Thus a sandwich is formed with the honeycomb structure between two flexible sheets of metal. After having been clamped to the bonding fixture for a predetermined curing time, the metal sheets and the honeycomb fixture are permanently deformed into the shape defined by the bonding fixture. The fabricated panel is then released from the bonding fixture, attached to a rigid frame, and arranged with other antenna panels to form a complete antenna reflector surface.

In lieu of using the solid bonding fixture, antenna panels can be advantageously fabricated using an adjustable bonding fixture disclosed and claimed in the co-pending commonly owned patent application entitled, "*Adjustable Bonding Fixture For Antenna Panel Fabrication*", Ser. No. 885,515, filed July 14, 1986 now U.S. Pat. No. 4,731,144. Using the adjustable bonding fixture, antenna panels are fabricated by laying a blank plastic or metal sheet over vertical adjustment rods threaded into a base plate. The adjustment rods are positioned at a predetermined distance above the base plate to provide the desired antenna panel shape. A honeycomb structure is then glued over the metal sheet, and a second metal sheet is glued to the exposed side of the honeycomb structure. The base plate and the entire antenna assembly are then enclosed and a vacuum is drawn within the enclosure. The vacuum causes the two sheets and the honeycomb structure to be formed into a shape defined by the tops of the adjustment rods. After the adhesive has cured, the antenna panel is permanently deformed into the desired shape. The antenna panel is then attached to a rigid frame and arranged with other panels to form a complete antenna reflector surface.

In lieu of the metal-honeycomb-metal sandwich, an antenna panel can also be formed by clamping a single metal sheet to the bonding fixture, and gluing a kerfed channel frame to the metal skin. The kerfed frame is a channel member with slits cut into it to make it flexible. After the glue has cured, the assembly is released from the bonding fixture. The skin, which was deformed by the clamps into the proper shape, is now held in that shape by adhesion to the kerfed channel. The kerfed channel assembly operation can be performed using either the well-known solid bonding fixture or the adjustable bonding fixture disclosed in the commonly-owned patent application.

The primary disadvantage of both of these antenna panel fabrication techniques is that neither provides a means to improve panel surface accuracy after the panel is released from the bonding fixture. Both of these techniques rely primarily on the conformance of the panel skin to the shape (i.e., surface curvature) defined by the solid or adjustable bonding fixture. There is no provision to improve the panel surface accuracy once the panel is released from the mold. Further, there are no means to compensate for the expected and slight spring-back of the panel after its release from the mold. Thus using these available antenna panel fabrication techniques, it is difficult to guarantee perfect conformance of the skin to the mold surface, and it is impossible to eliminate or compensate for the spring-back that occurs after the panel is released from the mold.

A complete antenna dish consists of several panels, fabricated as discussed above, assembled together in a predetermined pattern. The panels are shaped such that when assembled together they form the desired dish shape. The total surface accuracy of the antenna reflector depends substantially on the surface accuracy of each individual panel and the assembled accuracy of these panels. Even if the antenna panels are fabricated and assembled to a desired accuracy, during its lifetime the antenna is subjected to environmental effects such as wind, ice, and snow that have a tendency to distort the shape of the dish and degrade dish performance. Further, as the operating frequencies of the antenna dish increase, the surface accuracy of the dish plays a more important role in the performance of the antenna. At the extra-high frequency (EHF) range (18 to 90 GHz) the surface accuracy of the antenna dish must be maintained below 0.005 inches root means square (RMS) for acceptable performance.

It is well-known in the prior art to provide an adjustment device at each corner of each antenna panel, between the panel and the rigid frame to which it is mounted. When the panels are assembled to form a complete reflector, the distance between the frame and the panel is adjusted to ensure that each panel is flush with the adjacent panel.

SUMMARY OF THE INVENTION

To overcome the disadvantages discussed above, the antenna reflector of the present invention utilizes several adjustable support members placed at strategic locations and interposed between the antenna panel and the rigid frame to which it is attached. The adjustable support members are bonded or rigidly attached to the back side of the panel skin and attached to the rigid frame with a lock nut arrangement. Adjustments of the panel surface are made at the rigid frame end of the adjustable support members by simply moving the adjustable support members through the frame hole and lock nut using the lock nut arrangement to lock them in place after adjustment. Spacing of the adjustable support members is selected based on the desired accuracy of the panel surface and the curvature of the panel.

These adjustable support members provide a means for correcting inaccuracies arising during panel fabrication (i.e., due to spring-back and manufacturing errors), reduce the fabrication and assembly errors, and improve surface accuracy of the antenna dish during its lifetime. Further, the present invention offers a technique for limited reshaping of the antenna panel from its off-the-mold shape.

BRIEF DESCRIPTION OF THE DRAWINGS

The present invention can be more easily understood, and the further advantages and uses thereof more readily apparent, when considered in view of the description of the preferred embodiments and the following figures in which.

DESCRIPTION OF THE PREFERRED EMBODIMENTS

Figure 1:
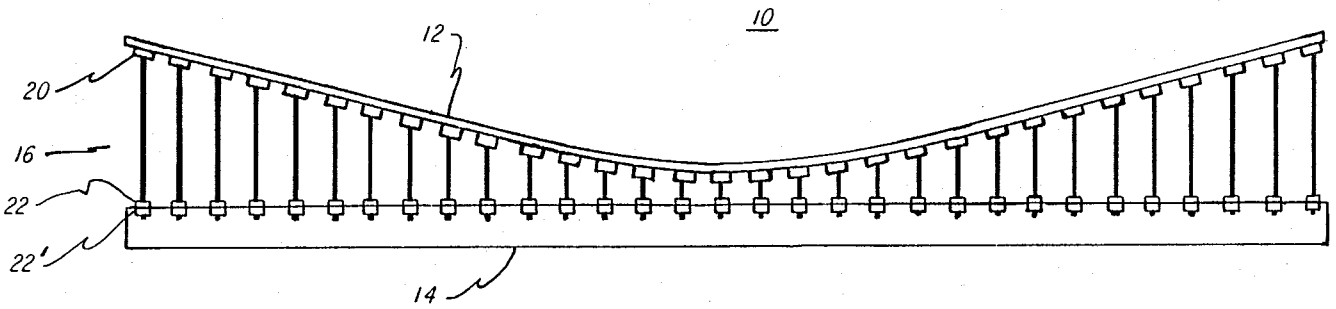
FIG. 1 is a cross-sectional view of an antenna panel constructed according to the teachings of the present invention.

FIG. 1 illustrates an antenna panel 10 constructed according to the teachings of the present invention. The antenna panel 10 includes a panel skin 12 and a frame 14. The panel skin 12 would have previously been shaped, as desired, for mating with other shaped panel skins to form a complete antenna reflector. Adjustable supports 16 are interposed between the panel skin 12 and the frame 14. Although only one row of adjustable supports is illustrated in FIG. 1, it should be understood that the antenna panel includes a plurality of rows of such adjustable supports 16 to form a matrix thereof, sufficient to provide adjustable support of the entire panel skin 12. For simplicity, the honeycomb structure and the kerfed channels discussed in the Background of the Invention are not shown in FIG. 1.

Figure 2:
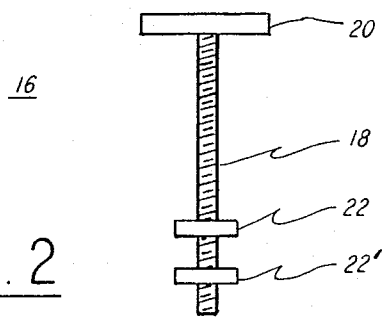
FIG. 2 is a detailed view of one of the adjustable support members shown in FIG. 1.

The adjustable supports 16 are shown more clearly in FIG. 2. Each adjustable support 16 includes a rod 18 and a flat base 20. Lock nuts 22 and 22' are threadably engaged on the threads of the rod 18. Although FIG. 2 shows threads along the entire length of the rod 18, it is well-known by those skilled in the art that threads along only a portion of the rod 18 would be sufficient.

As shown in FIG. 1, the flat base 20 is bonded or rigidly attached to the lower side of the panel skin 12. The other end of the rod 18 is located within through-holes in the frame 14. As shown in FIG. 1, a lock nut is placed above and below each hole in the frame 14 such that when the rod 18 passes therethrough the lock nuts 22 and 22' are tightened to firmly secure the adjustable support 16, and thus the panel skin 12, in the desired position. If it is desired to move the panel skin 12 away from the frame 14, the lock nut 22' is moved down the rod 18, away from the frame 14. Then the panel skin 12 is manually moved up (away from the frame 14), carrying the adjustable support 16 with it. After the panel skin is in the desired position, the upper lock nut 22 is threaded downwardly against the frame 14, and the lower lock nut 22' is threaded upwardly against the frame 14. Thus the lower lock nut 22' and the upper lock nut 22 lock the panel skin 12 in the desired position. A similar procedure is used when it is necessary to move the panel skin 12 toward the frame 14.

Note that FIG. 1 is a cross-sectional view through the frame 14 and the panel skin 12. In application, a matrix of adjustable support members 16 is placed between the frame 14 and the panel skin 12. The adjustable support members 16 can be placed at any desired location and spacing to provide the desired curvature adjustment capabilities. As can now be appreciated by those skilled in the art, the use of the adjustable support members 16 provides post-fabrication adjustment of an antenna's surface accuracy, whether the adjustments are necessitated by inaccuracies in construction or environmental effects.

After the panel skin 12 has been repositioned, the surface thereof is measured on a precision measurement machine and additional adjustments can be made to the adjustable support members 16 to improve the surface accuracy of the panel skin 12. Using this present invention the panel skin accuracy can be improved to at least 0.001 inches RMS, using a panel that had an initial accuracy of only 0.005 inches RMS. In practice, the surface accuracy of the panel skin 12 is limited only by the pitch of the threads on the threaded rods 18 and by the practical limits of measurement accuracy.

The frame 14 shown in FIG. 1 can comprise the well-known beam-like members, or a metal skin-honeycomb-metal skin sandwich arrangement. Use of the latter structure allows placement of the adjustable supports 16 at any point on the panel skin 12, while use of beam-like members would allow placement of the adjustable supports 16 only at those locations on the panel skin 12 which are opposite a beam member.

Although I have shown and described an embodiment in accordance with the present invention, it is understood that the present invention is not limited thereto but is susceptible of numerous changes and modifications as known to a person skilled in the art. I therefore do not wish to be limited to the details shown and described herein, but intend to cover all such changes and modifications as are obvious to one of ordinary skill in the art.

What is claimed is:

1. An antenna reflector comprising:

a rigid frame member;

a reflective surface;

a plurality of rigid adjustable support members distributed in a predetermined pattern over the area of said reflective surface, wherein a first end of each of said plurality of adjustable support members is attached to the back side of said reflective surface, and a second end thereof is adjustably coupled to said rigid frame member, wherein changing the effective length of said adjustable support members changes the shape of said reflective surface.

2. The antenna reflector of claim 1 wherein the rigid frame member includes a plurality of holes, and wherein each one of the plurality of rigid adjustable support members includes a rod having a threaded portion and two lock nuts threadably engaged thereon, and wherein each one of the plurality of adjustable support members is located in a hole of the rigid frame member with one of said two lock nuts positioned on each side thereof, such that when said two lock nuts are both urged against the frame member the reflective surface is held in the desired positon, and such that said two lock nuts are movable along said threaded portion for changing the shape of the reflective surface.

3. An antenna reflector comprising:

a rigid frame member;

a reflective surface;

a plurality of rigid adjustable support members distributed in a matrix pattern over the area of said reflective surface, wherein a first end of each of said plurality of adjustable support members is attached to the back side of said reflective surface, and a second end thereof is adjustably coupled to said rigid frame member, wherein changing the effective length of said adjustable support members changes the shape of said reflective surface.

* * * * *